US006690229B2

(12) United States Patent
Rudolph

(10) Patent No.: US 6,690,229 B2
(45) Date of Patent: Feb. 10, 2004

(54) FEED BACK CURRENT-SOURCE CIRCUIT

(75) Inventor: Jochen Rudolph, Neu Wulmstorf (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/323,352

(22) Filed: Dec. 18, 2002

(65) Prior Publication Data

US 2003/0117210 A1 Jun. 26, 2003

(30) Foreign Application Priority Data

Dec. 21, 2001 (DE) ..... 101 63 633

(51) Int. Cl.[7] ..... G05F 1/10
(52) U.S. Cl. ..... 327/543; 327/538; 323/316
(58) Field of Search ..... 327/538, 540, 327/541, 543, 539; 323/312, 313, 315, 316

(56) References Cited

U.S. PATENT DOCUMENTS 5,087,891 A * 2/1992 Cytera ..... 330/288
5,680,037 A * 10/1997 Carobolante ..... 323/315
5,694,072 A * 12/1997 Hsiao et al. ..... 327/537
5,844,434 A 12/1998 Eschauzier ..... 327/143
5,854,566 A * 12/1998 Kwon et al. ..... 327/403
6,087,820 A * 7/2000 Houghton et al. ..... 323/315
6,381,491 B1 * 4/2002 Maile et al. ..... 327/539
6,466,081 B1 * 10/2002 Eker ..... 327/541

FOREIGN PATENT DOCUMENTS

JP 60061859 3/1994

* cited by examiner

*Primary Examiner*—Terry D. Cunningham
(74) *Attorney, Agent, or Firm*—Aaron Waxler

(57) ABSTRACT

In a current-source circuit in which a first and a second MOS field-effect transistor form a current mirror circuit, wherein a reference current can be supplied to the first MOS field-effect transistor via a third MOS field-effect transistor connected in cascode and the drain electrode of a fourth MOS field-effect transistor connected to the second MOS field-effect transistor in cascode forms an output, the source electrodes of the third and of the fourth MOS field-effect transistors are connected to inputs of an automatic gain control amplifier whose output is connected to the gate electrode of the fourth MOS field-effect transistor. The fourth MOS field-effect transistor is an extended-drain MOS field-effect transistor. The drain electrode and the gate electrode of the fourth MOS field-effect transistor are connected to one another via a further MOS field-effect transistor whose gate electrode is acted on by an operating voltage for the circuit.

5 Claims, 1 Drawing Sheet

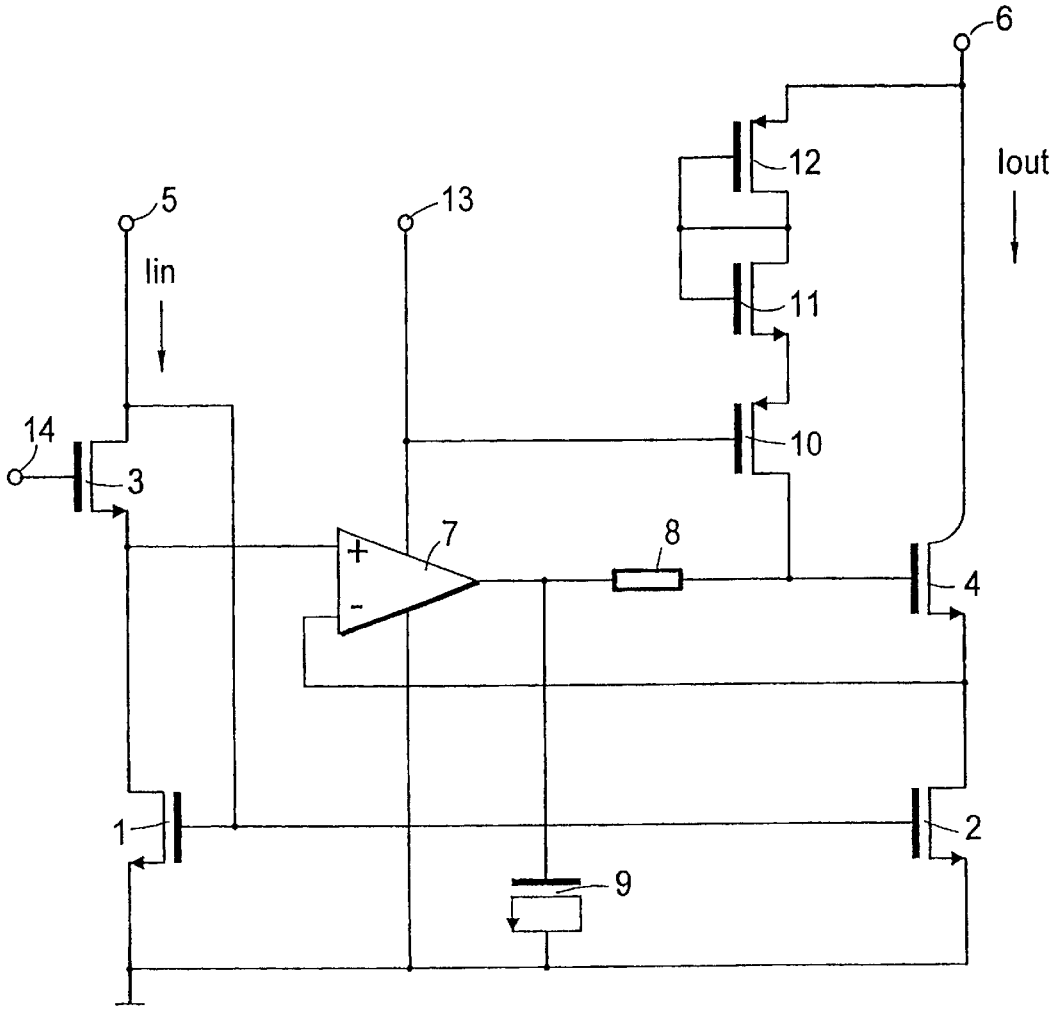
6
12
Iout
5
13
Iin
11
14
10
3
7
8
+
-
4
1
2
9

FEED BACK CURRENT-SOURCE CIRCUIT

BACKGROUND OF THE INVENTION

The invention relates to a current-source circuit in which a first and a second MOS field-effect transistor form a current mirror circuit, wherein a reference current can be supplied to the first MOS field-effect transistor via a third MOS field-effect transistor connected in cascode and the drain electrode of a fourth MOS field-effect transistor connected to the second MOS field-effect transistor in cascode forms an output.

For various circuitry purposes, current sources are needed that should have as high an output impedance as possible. The higher the output impedance, the lower is the dependence of the output current on the voltage present.

A simple current mirror circuit comprises two transistors, in particular MOS field-effect transistors whose source and gate electrodes are each connected to the other. Furthermore, the gate electrode and the drain electrode of the one transistor are connected to one another and are acted on by a reference current. The desired output current can then be drawn from the drain electrode of the other MOS field-effect transistor. Said output current is, however, dependent on the voltage present at the other MOS field-effect transistor (also referred to below as output transistor) since its parameters are voltage-dependent.

It is possible to reduce this dependence with cascode circuits such as are disclosed, for example, in U.S. Pat. No. 5,844,434. To stabilize the current further it has become known, for example, from JP 0060061859AA, to automatically control the source electrode of the output transistor by controlling the gate electrode to a constant potential. This increases the output impedance by the loop gain compared with a simple cascode circuit.

If implemented in a submicron process, however, said high output impedance is available only in a limited output-voltage range. In the case of higher output voltages, a substrate current flows directly from the drain of the cascode transistor to the substrate owing to the hot-carrier effect. Said substrate current is not influenced by the automatic control and results in a drastic reduction of the output impedance. The reduction in the output impedance can be compensated for only slightly even by increasing the channel length of the output transistor.

SUMMARY OF THE INVENTION

It is an object of the invention to provide a current-source circuit that has a high output impedance in a large output-voltage range.

According to the invention, said object is achieved in that the source electrodes of the third and fourth MOS field-effect transistors are connected to inputs of an automatic gain control amplifier, whose output is connected to the gate electrode of the fourth MOS field-effect transistor, in that the fourth MOS field-effect transistor is an extended-drain MOS field-effect transistor and in that the drain electrode and the gate electrode of the fourth MOS field-effect transistor are connected to one another via a further MOS field-effect transistor whose gate electrode is acted on by an operating voltage for the circuit.

Since the problems in n-channel MOS field-effect transistors mentioned at the outset occur substantially more seriously, one embodiment of the invention is particularly advantageous in that the extended-drain MOS field-effect transistor is an extended-drain n-well MOS field-effect transistor and in that the further MOS field-effect transistor is a p-channel MOS field-effect transistor.

The current-source circuit according to the invention has the advantage of a high output impedance over a very large output-voltage range, wherein the output voltage may exceed the operating voltage permissible for this technology. To achieve these properties, no additional mask steps are needed for special high-voltage transistors. Furthermore, the current-source circuit according to the invention can also be operated at an output voltage that is higher than the operating voltage of the remaining circuit. In addition, the current-source circuit according to the invention has a high current-balance ratio precision in the operating voltage, output voltage and temperature range.

The current-source circuit according to the invention serves as current balance if the reference current is supplied externally. With an internal reference current source, the current-source circuit according to the invention is also a highly precise current source.

In addition to the high output impedance in a large output-voltage range, the current-source circuit according to the invention has the advantage that, in contrast to other known circuits, it is not destroyed if voltage is present at the output transistor while the circuit itself, that is to say the automatic gain control amplifier and further circuit elements, is still not being supplied with an operating voltage. Finally, the current-source circuit according to the invention has the advantage that it can be used in highly integrated standard CMOS technologies. In addition, the service life of the current-source circuit is increased by avoiding the hot-carrier effect at high output voltages.

An advantageous embodiment of the current-source circuit according to the invention is that at least one MOS field-effect transistor connected as a diode is connected in series with the further MOS field-effect transistor.

Another advantageous embodiment is constructed in such a way that the output of the automatic gain control amplifier is connected to the gate electrode of the fourth MOS field-effect transistor via a resistor, wherein provision is preferably made that the automatic gain control amplifier is formed by an operational transconductance amplifier. In the case of a voltage at the output transistor that is higher than the operating voltage, this embodiment prevents the current conducted from the further MOS field-effect transistor to the gate electrode from being short-circuited by diodes situated on the output side in the automatic gain control amplifier.

Extended-drain MOS field-effect transistors, which are also referred to as lightly doped drain n-well transistors or lightly doped drift region transistors, are described, for example, in "Submicron BiCMOS compatible high-voltage MOS transistors" by Y. Q. Li, C. A. T. Salama, M. Seufert and M. King in ISPSD Proc., 1994, pp. 355–359.

These and other aspects of the invention are apparent from and will be elucidated with reference to the embodiment described hereinafter. In the latter, apart from exceptions specified in greater detail, the transistors are constructed as n-channel MOS field-effect transistors.

BRIEF DESCRIPTION OF THE DRAWINGS

The FIGURE shows a circuit according to the present invention.

DETAILED DESCRIPTION OF THE INVENTION

A first MOS field-effect transistor 1 and a second MOS field-effect transistor 2 are the actual current balance to which a reference current Iin can be supplied via an input 5. A current mirror circuit is known per se and does not need to be explained in greater detail in connection with the present invention. It may be mentioned briefly, however, that the current Iout that can be drawn from the output 6 is in a certain ratio to the reference current determined by transistor geometries. In order to reduce the action of various high voltages at the input 5 and at the output 6, a third transistor 3 having a bias supplied at 14 and a fourth transistor are each connected in cascode to the first and second transistors, the MOS field-effect transistor 4 being referred to below as output transistor. In addition, the two source voltages of the cascode transistors 3, 4 are compared with one another in an OTA (Operational Transconductance Amplifier) 7, as a result of which a control signal is produced that is supplied to the gate electrode of the output transistor 4 via a resistor 8. To damp the oscillation tendency of the closed loop, an MOS field-effect transistor 9 is connected as a capacitor between the output of the OTA 7 and ground potential.

The trend of modern CMOS technologies is to reduce further the transistor dimensions and reduce the gate-oxide thickness of the transistors. Associated with this is a reduction in the supply voltage of such chips manufactured in deep-submicron technology. In certain applications, such as, for example, an interface with chips with high supply voltage or controlling power drivers, it is necessary for the output stage to be able to assume a higher voltage than its own supply voltage permissible for this technology. For such "high-voltage" applications, the service life of the transistors used in the output stage is in this context the main problem.

With suitable dimensioning of the n-well drift region, a high service life is achieved up to the maximum output voltage by using an extended-drain transistor. A gate-oxide breakdown is prevented under all conditions by the transistor combination 10, 11, 12.

In circuit systems having various voltage supplies, it may occur that the voltage supply has already reached the maximum voltage value after starting, but another voltage supply is not yet present. A so-called fail-safe mode is necessary for this operating state. In the exemplary embodiment shown, the series connection comprising a p-channel MOS field-effect transistor 10 and the two n- or p-channel MOS field-effect transistors 11 and 12 connected as diodes protects the output transistor 4 in the case where a voltage is already present at the output 6 while the operating voltage supplied at 13 is not (yet) present. The transistor 10 receives 0 V as gate potential under these circumstances and switches, via the MOS field-effect transistors 11, 12, the gate-drain voltage of the output transistor 4 to a value that is below a gate-oxide breakdown voltage. Under these circumstances, the resistor 8 serves to decouple the OTA output. After starting the operating voltage at 13, the MOS field-effect transistor 10 turns off, with the result that the operation of the cascode automatic control is no longer affected.

What is claimed is:

1. A current-source circuit in which a first and a second MOS field-effect transistor form a current mirror circuit, wherein a reference current is supplied to the first MOS field-effect transistor via a third MOS field-effect transistor receiving an input at the gate and connected in cascode and the drain electrode of a fourth MOS field-effect transistor connected to the second MOS field-effect transistor in cascode forms an output, characterized in that the source electrodes of the third (3) and the fourth (4) MOS field-effect transistors are connected to inputs of an automatic gain control amplifier (7), whose output is connected to the gate electrode of the fourth MOS field-effect transistor (4), in that the fourth MOS field-effect transistor (4) is an extended-drain MOS field-effect transistor and in that the drain electrode and the gate electrode of the fourth MOS field-effect transistor (4) are connected to one another via a further MOS field-effect transistor (10) whose gate electrode is acted on by an operating voltage for the circuit.

2. A current-source circuit as claimed in claim 1, characterized in that the extended-drain MOS field-effect transistor is an extended-drain n-well MOS field-effect transistor (4) and in that the further MOS field-effect transistor is a p-channel MOS field-effect transistor (10).

3. A current-source circuit as claimed in claim 2, characterized in that at least one MOS field-effect transistor (11, 12) connected as a diode is connected in series with the further MOS field-effect transistor (10).

4. A current-source circuit as claimed in claim 1, characterized in that the output of the automatic gain control amplifier (7) is connected to the gate electrode of the fourth MOS field-effect transistor (4) via a resistor (8).

5. A current-source circuit as claimed in claim 1, characterized in that the automatic gain control amplifier is formed by an operational transconductance amplifier (7).

* * * * *